US008648520B2

(12) United States Patent
Chen et al.

(10) Patent No.: US 8,648,520 B2
(45) Date of Patent: Feb. 11, 2014

(54) INNER COUPLING TUBULAR TYPE ELECTRODELESS LAMP

(75) Inventors: Wenjun Chen, West Covina, CA (US); Heping Chen, Fujian (CN); Hequan Zhang, Fujian (CN); Jingping Wu, Fujian (CN)

(73) Assignee: Fujian Juan Kuang Yaming Electric Limited, Nanping, Fujian (CN)

( * ) Notice: Subject to any disclaimer, the term of this patent is extended or adjusted under 35 U.S.C. 154(b) by 0 days.

(21) Appl. No.: 12/993,845

(22) PCT Filed: Sep. 9, 2010

(86) PCT No.: PCT/CN2010/076748

§ 371 (c)(1),
(2), (4) Date: Nov. 21, 2010

(87) PCT Pub. No.: WO2012/031396

PCT Pub. Date: Mar. 15, 2012

(65) Prior Publication Data

US 2013/0181606 A1 Jul. 18, 2013

(51) Int. Cl.
*H01J 1/62* (2006.01)
*H01J 63/04* (2006.01)

(52) U.S. Cl.
USPC ..... 313/489; 313/483; 313/484; 313/485; 313/490; 313/491; 313/493

(58) Field of Classification Search
None
See application file for complete search history.

(56) References Cited

U.S. PATENT DOCUMENTS 5,808,414 A * 9/1998 Wharmby et al. ..... 313/607
2013/0181600 A1* 7/2013 Chen et al. ..... 313/490

FOREIGN PATENT DOCUMENTS

CN 101950716 A * 1/2011

* cited by examiner

*Primary Examiner* — Natalie Walford

(57) ABSTRACT

An inner coupling tubular type electrodeless lamp comprises a glass bulb, an amalgam, and a power coupler. The glass bulb includes an external portion and an inner portion. A gas discharging cavity that is annularly airtight is defined by an envelopment of the external portion and the inner portion. A coupling cavity is defined in the inner portion. The power coupler includes a radiating post, a ferrite core, and a winding sequentially situating from an interior to an exterior thereof. The power coupler is disposed in the coupling cavity. Two ends of the coupling cavity are intercommunicated with each other as well as the exterior. The external portion of the glass bulb adopts the elongated tube. Wherein, a length of the ferrite core of the power coupler is not smaller than a half length of the coupling cavity. A length of the winding is measured from one-fifth to four-fifth of the length of the coupling cavity to evenly distribute an electromagnetic field. At least one diffuse reflection layer that is made of a material falling in a 250~2000 nm spectrum scope is disposed between an inner wall of the inner portion (the side near the power coupler) and an external surface of the power coupler. Wherein, the material for making the diffuse reflection layer adopts a non-conducting electricity material that resists a temperature higher than 100° C.

10 Claims, 3 Drawing Sheets

INNER COUPLING TUBULAR TYPE ELECTRODELESS LAMP

BACKGROUND OF THE INVENTION

1. Field of the Invention

The present invention relates to an inner coupling electrodeless lamp, in particularly to an inner coupling tubular type electrodeless lamp.

2. Description of the Related Art

The conventional electrodeless lamp could be classified into two types in accordance with the structures and the means for power coupling. One of the classifications is the external coupling electrodeless lamp, and the other of the classifications is the inner coupling globe type electrodeless lamp. The light emitted from these two types of electrodeless lamps belongs to the surface light source. A tubular diameter of the external coupling electrodeless lamp is in fact not large. However, a discharging circuit of such fluorescent lamp should adopt a loop shape. Herein, an annular and close tube for such fluorescent lamp is formed. Nonetheless, the formation of either an annular tube or a rectangular tube for cooperating with the fixture exists in a certain difficulty. Moreover, a diameter of the bulb of the inner coupling globe type electrodeless lamp is rather large. Correspondingly, the design for a reflector cooperating with the lamp thereof is actually complicated. Herein, if a light distribution curve of such globe lamp is unavailable, a requirement for the light distribution of a street fixture of TYPE III is unable to be met. Additionally, only one end of the inner coupling globe type electrodeless lamp is designed open so that one end of the coupling cavity could be designed open. As a result, the other end of the globe lamp is accordingly designed close, and an inferior ventilating environment is incurred, so an unsatisfactory radiating effect is adversely caused. Consequently, the using life of the lamp is largely influenced. Herein, the inner coupling globe type electrodeless lamp is in fact monotonous, and so is its practical adopting environment. Therefore, an inner coupling tubular type electrodeless lamp is disclosed in the market.

An inner coupling tubular type electrodeless lamp with two ends thereof is disclosed by the same applicant as that of the present invention. The publication no. of afore disclosure is CN1560898 (U.S. Pat. No. 6,940,232 B1 Filed Feb. 27, 2004), and the publication date is Jan. 5, 2005. The electrodeless lamp has an airtight glass holder with a ventilating shaft disposed thereon. Namely, a coupling cavity of the disclosure is designed by the disposition of two open ends (as shown in claim 9 and FIG. 6 of the disclosure). Thereby, the air is convected within the ventilating shaft. Moreover, dual conducting posts provide a satisfactory heating scattering effect. Thus, the heat generated in the bulb could be efficiently dispersed. Such disclosure solves the existing heat conducting problem in the bulb.

However, a ratio of the surface area of the inner portion to the external surface of the bulb is in fact not small in either the inner coupling globe type electrodless lamp or the inner coupling tubular type electrodeless lamp that is designed with two open ends. That is to say, the light emitted from the fluorescent powder on the inner portion can not be well utilized, so that the influenced illuminant performance still adversely exists.

SUMMARY OF THE INVENTION

The object of the present invention is to provide an inner coupling tubular type electrodeless lamp; such fluorescent lamp has a satisfactory radiating effect as well as an adequate light distribution performance.

The present invention is achieved by the following techniques: An inner coupling tubular type electrodeless lamp comprises a glass bulb, an amalgam and a power coupler. The glass bulb includes an external portion and an inner portion. A gas discharging cavity that is annularly airtight is defined by an envelopment of the external portion and the inner portion. A coupling cavity is defined in the inner portion. The power coupler includes a radiating post, a ferrite core, and a winding sequentially situating from an interior to an exterior thereof. The power coupler is disposed in the coupling cavity. Two ends of the coupling cavity are intercommunicated with each other as well as communicated with the exterior. Characterized in that the external portion of the glass bulb adopts an elongated tube. A length of the ferrite core of the power coupler is not smaller than a half length of the coupling cavity. A length of the winding is measured from one-fifth to four-fifth of the length of the coupling cavity to evenly distribute an electromagnetic field. At least one diffuse reflection layer that is made of a material falling in a 250~2000 nm spectrum scope is disposed between an inner wall of the inner portion and an external surface of the power coupler; wherein, the material for making the diffuse reflection layer adopts a non-conducting electricity material that resists a temperature higher than 100° C.

The diffuse reflection layer resists a temperature higher than 250° C., such as the F4, PTFE, TEFLON; the diffuse reflection layer covers the inner wall of the inner portion or covers the external surface of the power coupler; a thickness of the diffuse reflection layer is measured from 0.01 to 5 mm.

A ratio of a maximal diameter of the external portion to a diameter of the coupling cavity is between 10:2 and 10:5. Afore ratio is able to solve the contradiction between the coupling efficiency and the diffuse reflection efficiency. Herein, the smaller the diameter of the inner portion is, the smaller the diameter of the coupling cavity is. The larger effective illuminant cross-section of the discharging of the electrodeless lamp is, the higher the coupling efficiency is. Wherein, a small diameter of the inner portion contributes to a decreased surface area of a utilized diffuse reflection film. The external portion of the glass bulb adopts a straight tube, a gourdshaped, or a straight section in the middle with arcs at two ends thereof; a cross-section of the coupling cavity adopts a circle, a triangle, or a polygon.

The radiating post of the power coupler flatly contacts the ferrite core. The radiating post of the power coupler adopts a flat structure; an upper ferrite core and a lower ferrite core of the ferrite core are respectively fixed to a front side and a back side of the flat radiating post; each ferrite core has at least one plane for contacting a surface of the radiating post. The ferrite core adopts a structure in a continuous single section, in a two-sectional connection, or in a multi-sectional connection; the winding is disposed in the coupling cavity by an integral and even distribution or with a grouped and even distribution.

The external portion and the inner portion are coaxially disposed so as to form a symmetrical structure, thereby promoting the light distribution efficiency.

Advantages of the present invention are as follows: At least one diffuse reflection layer is disposed between the inside (the side near the power coupler, the non-discharging side) of the inner portion of the glass bulb and the external surface of the power coupler. The diffuse reflection layer adopts a non-conducting electricity material that is able to resist a high temperature, provide a wide spectrum, as well as offer a high diffuse reflection rate. Visible light and ultrared ray emitted from an illuminant area on the inner portion of the bulb are reflected by the diffuse reflection material back to the annularly airtight discharging cavity. Thereby, the visible light and the ultrared ray penetrate the external surface of the glass bulb and reuse the waste visible light. Wherein, the visible light and the ultrared ray are not directly cast on the external surface of the power coupler, so the illuminant efficiency could be largely promoted, the operating temperature could be effectively decreased, and the using life of the lamp could be beneficially enhanced. Moreover, the inner coupling tubular type electrodeless lamp adopting a proper ventilating environment allows the electromagnetic field to be distributed evenly. Thereby, the dissolving state of the plasma is also distributed evenly so as to enhance the illuminant efficiency. Practically, the inner coupling electrodeless lamp with two ends thereof adopts the single tube structure for conveniently cooperating with the lamp, so the requirement for the light distribution with the street fixture of TYPE III could be readily met.

DETAILED DESCRIPTION OF THE PREFERRED EMBODIMENTS

First Preferred Embodiment

Figure 1:
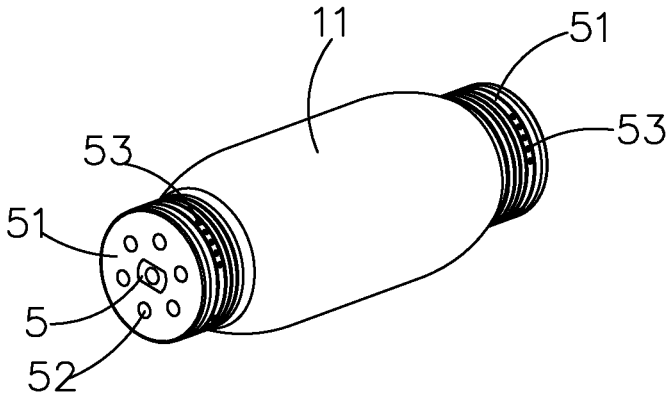
FIG. 1 is a schematic view showing the exterior structure of a first preferred embodiment of the present invention.
Figure 2:
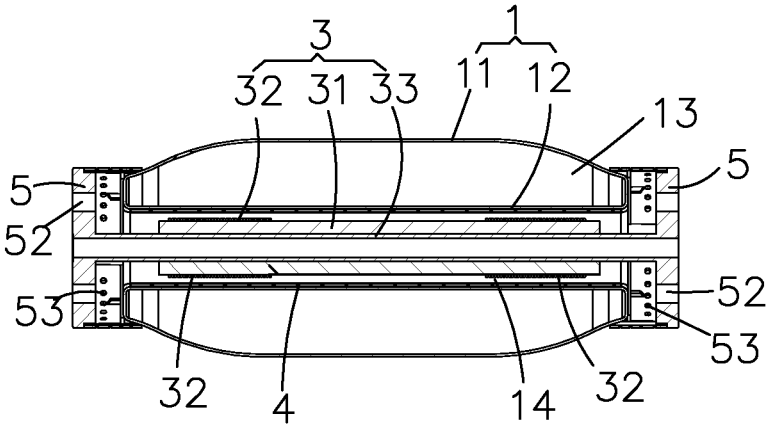
FIG. 2 is an axially cross-sectional view of FIG. 1.

Referring to FIGS. 1 and 2, an inner coupling tubular type electrodeless lamp 10 for an elongated tube comprises a glass bulb 1 and a power coupler 3.

The glass bulb 1 includes an external portion 11 and an inner portion 12. A gas discharging cavity 13 that is annularly airtight is defined by an envelopment of the external portion 11 and the inner portion 12. An internal wall of the annularly airtight discharging cavity 13 is coated with the fluorescent powder. A coupling cavity 14 is defined in the inner portion 12. A cross-section of the coupling cavity 14 adopts a circle, a triangle, or a polygon. Two ends of the coupling cavity 14 are not designed close, so that they are intercommunicated with each other for forming an open structure and offering an appropriate ventilating environment. Thereby, the radiating effect is satisfying. Usually, the smaller the diameter of the inner portion 12 is, the smaller the diameter of the coupling cavity 14 is. The larger effective illuminant cross-section of the discharging of the electrodeless lamp is, the higher the coupling efficiency is. Wherein, a small diameter of the inner portion 12 contributes to a decreased surface area of a utilized diffuse reflection film. A ratio of a maximal diameter of the external portion 11 to a diameter of the coupling cavity 14 (an inner diameter of the inner portion 12) is between 10:2 and 10:5. Afore ratio is able to solve the contradiction between the coupling efficiency of the power coupler 3 and the diffuse reflection efficiency. Thereby, the light distribution efficiency could be promoted.

The power coupler 3 includes a radiating post 33, a ferrite core 31, and a winding 32 sequentially situating from an interior to an exterior thereof. The radiating post 33 is disposed in the coupling cavity 14 of the inner portion 12 as well as axially disposed along the inner portion 12. A length of the ferrite core 31 of the power coupler is longer than a half length of the coupling cavity 14. A length of the winding 32 is measured from one-fifth to four-fifth of the length of the coupling cavity 14.

In this embodiment, the external portion 11 of the glass bulb 1 is designed by a straight section in the middle with arcs at two ends thereof. Namely, an elongated tube whose axial direction is rather long is shown like a tube. The radiating post 33 of the power coupler 3 adopts a flat structure. An upper ferrite core and a lower ferrite core of the ferrite core 31 are respectively fixed to a front side and a back side of the flat radiating post 33. Each ferrite core 31 has at least one plane for contacting a surface of the radiating post 33 for enhancing the heat dispersing effect. The ferrite core 31 adopts a structure in a continuous single section. Namely, the ferrite core 31 is not separated. Two sets of the windings 32 are disposed on the radiating post 33 for being intercommunicatively connected to form a united winding. Wherein, the windings 32 are disposed at two ends in the coupling cavity 14 for evenly distributing the electromagnetic field and preferably promoting the light distribution efficiency.

A reflection layer 4 covers the inner wall of the inner portion 12. Wherein, the reflection layer 4 adopts the F4, PTFE, TEFLON whose thickness is measured from 0.01 to 5 mm.

In the covering operation, the F4, PTFE, TEFLON is formed into a film. Accordingly, the film is evenly pasted on the inner wall of the inner portion 12 to form the reflection layer 4. In fact, the F4, PTFE, TEFLON could be alternatively formed into the cream state. Accordingly, the inner wall of the inner portion 12 could be coated with the cream so as to form the reflection layer 4.

Herein, the diffuse reflection rate of the F4, PTFE, TEFLON is rather high while existing in the spectrum scope falling in 250 to 2500 nm. Moreover, the spectrum of reflection is flat and preferably resists a temperature (higher than 250 degrees centigrade), so such features are suited to the electrodeless lamp. Accordingly, in radiating the electrodeless lamp in this embodiment, partial visible light and ultrared ray going toward the coupling cavity 14 from the gas discharging cavity 13 are reflected back to the gas discharging cavity 13 in view of the resistance of the reflection layer 4. Thereby, the visible light and the ultrared ray are leaked from the external surface of the glass bulb, rather than being directly cast and absorbed on the external surface of the power coupler 3. Consequently, the illuminant efficiency of the lamp body is enhanced, and the operating temperature in the coupling cavity 14 of the inner portion 12 is decreased. Preferably, the integral performance of the power coupler 3 would not be affected, and the ultraviolet does not damage the power coupler 3, either. Therefore, the using life of the present invention is promoted.

Another preferred embodiment of the present invention adopts a radiating lid 5 being further disposed on two ends of the radiating post 33. At least either type of plural axial openings 52 or plural radio openings 53 are defined on the radiating lid 5. Moreover, the axial openings 52 or the radial openings 53 are intercommunicated with the coupling cavity 14 of the inner portion. Thereby, cooperating with the radiating lid 5, two ends of the coupling cavity 14 of the inner portion 12 are able to intercommunicated with the exterior, so that the air could be convected and dispersed within the coupling cavity 14.

Second Preferred Embodiment

Figure 3:
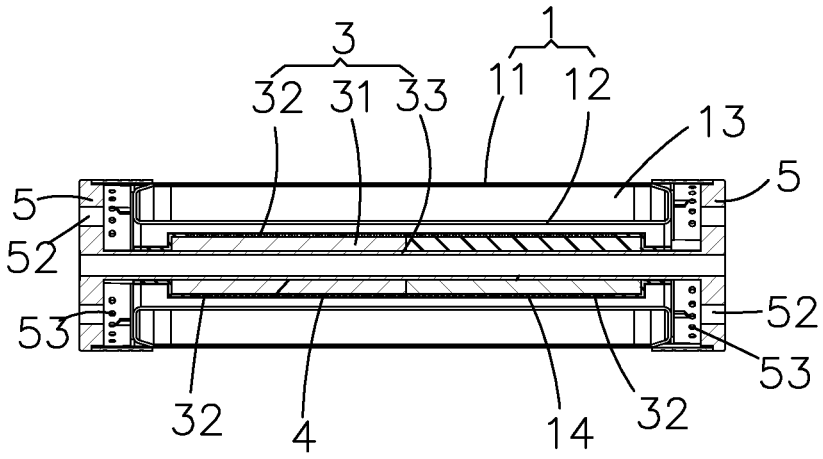
FIG. 3 is a schematic view showing the interior structure of a second preferred embodiment of the present invention.

Referring to FIG. 3, different from that of the first preferred embodiment, the external portion 11 of the glass bulb 1 in this embodiment adopts a straight tube, or an elongated tube.

Different from that of the first preferred embodiment, in the covering operation of this preferred embodiment, the diffuse reflection layer covers the external surface of the power coupler 3. Wherein, the F4, PTFE, TEFLON is firstly formed into a film. Accordingly, the film evenly covers the external surface of the power coupler 3 to form the reflection layer 4. In fact, the F4, PTFE, TEFLON could be alternatively formed into the cream state. Accordingly, the external surface of the power coupler 3 could be coated with the cream so as to form the reflection layer 4. Thereby, the favorable efficiency similar to that in the first preferred embodiment could be also achieved.

Different from that of the first preferred embodiment, the ferrite core 31 adopts a structure in a two-sectional connection. The length of the winding 32 is four-fifth length of the coupling cavity 14. The winding 32 is disposed on the radiating post 33 in the coupling cavity 14 by an integral and even distribution to evenly distribute the electromagnetic field, and the promoted light distribution efficiency could be achieved.

Third Preferred Embodiment

Figure 4:
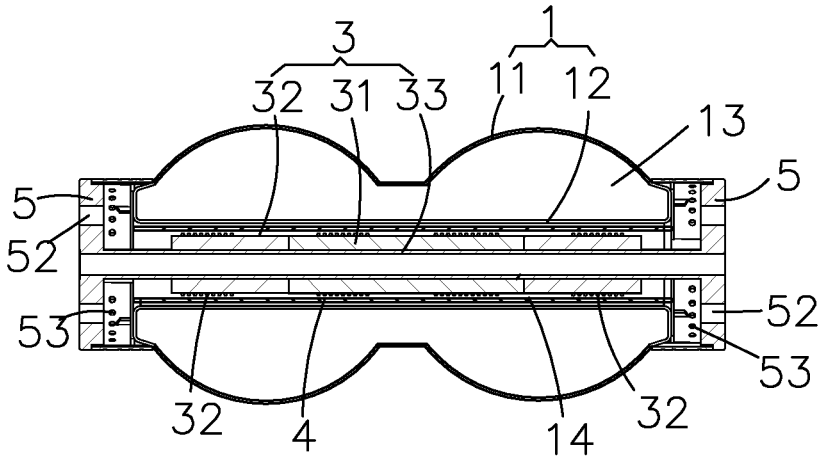
FIG. 4 is a schematic view showing the interior structure of a third preferred embodiment of the present invention.

Referring to FIG. 4, the external portion 11 of the glass bulb 1 in this embodiment adopts a gourdshaped glass bulb, or an elongated tube.

Different from the previous embodiments, the diffuse reflection layer 4 in this embodiment could be alternatively disposed at any place between the inner wall of the inner portion 12 and the external surface of the power coupler 3. The disposition of the diffuse reflection layer 4 could be achieved by forming the F4, PTFE, TEFLON through a die. Thereby, the diffuse reflection layer 4 could be disposed at any appropriate place, so that the same preferred effect as that of the previous embodiments could be similarly achieved.

Different from that of the previous preferred embodiments, the ferrite core 31 adopts a structure in a three-sectional connection. The length of the winding 32 is two-fifth length of the coupling cavity 14. Multiple sets of the winding 32 are disposed on the radiating post 33 in the coupling cavity 14 with an even distribution to evenly distribute the electromagnetic field, and the promoted light distribution efficiency could be achieved.

Fourth Preferred Embodiment

Figure 5:
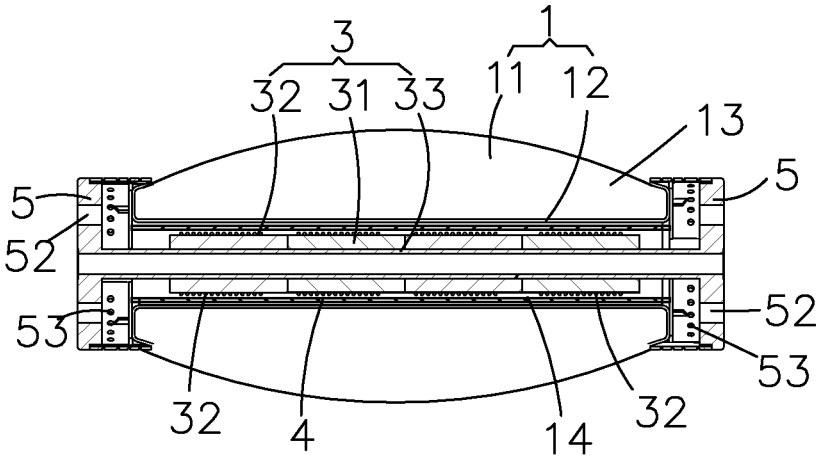
FIG. 5 is a schematic view showing the interior structure of a fourth preferred embodiment of the present invention.

Referring to FIG. 5, the external portion 11 of the glass bulb 1 in this embodiment adopts an arc structure, or an elongated tube.

Different from the previous embodiments, the ferrite core 31 adopts a structure in a four-sectional connection. The length of the winding 32 is three-fifth length of the coupling cavity 14.

In afore four preferred embodiment, the external portion 11 of the glass bulb 1 is formed into the elongated tube. Herein, the magnetic field formed by the discharging circuit in the winding 32 that is disposed on the surface of the ferrite core 31 of the power coupler 3 is axial. That is, the induced electromagnetic field is enveloped along a periphery. In addition, the direction of the circuit arc goes around the periphery of the power coupler 3 for evenly distributing within the annularly airtight discharging cavity 13 that is encompassed by the external portion 11 an the inner portion 12. Thus, in contrast with the inner coupling globe type electrodeless lamp, the present invention has a more even light distribution effect. Moreover, the cross-section of the inner portion 12 is not limited in the present invention. Namely, a circle inner portion, a triangle inner portion, or a polygon inner portion is acceptable. In addition, afore preferred embodiments adopt the F4, PTFE, TEFLON to serve as the diffuse reflection layer. Preferably, other non-conducting electricity material that resists a temperature and contains a high diffuse reflection rate is also suitable. Moreover, in the present invention, the diffuse reflection layer could be alternatively disposed by single layer, double layers, or multiple layers. Further, the contour of the radiating post of the power coupler is not limited to the flat formation. While any radiating post that has an appropriate width with at least one plane for contacting the plane of the ferrite core, the radiating post is capable of dispersing heat.

We claim:

1. An inner coupling tubular type electrodeless lamp comprising a glass bulb, an amalgam, and a power coupler; said glass bulb including an external portion and an inner portion; a gas discharging cavity that is annularly airtight being defined by an envelopment of said external portion and said inner portion; a coupling cavity being defined in said inner portion; said power coupler including a radiating post, a ferrite core, and a winding sequentially situating from an interior to an exterior thereof; said power coupler being disposed in said coupling cavity; two ends of said coupling cavity being intercommunicated with each other as well as communicated with the exterior; said external portion of said glass bulb adopting an elongated tube; characterized in that a length of said ferrite core of said power coupler is not smaller than a half length of said coupling cavity; a length of said winding is measured from one-fifth to four-fifth of said length of said coupling cavity to evenly distribute an electromagnetic field; at least one diffuse reflection layer that is made of a material falling in a 250~2000 nm spectrum scope being disposed between an inner wall of said inner portion and an external surface of said power coupler, said material for making said diffuse reflection layer adopting a non-conducting electricity material that resists a temperature higher than 100° C.

2. The lamp as claimed in claim 1, wherein, said diffuse reflection layer resists a temperature higher than 250° C.

3. The lamp as claimed in claim 2, wherein, said diffuse reflection layer adopts the F4, PTFE, TEFLON.

4. The lamp as claimed in claim 1 or 3, wherein, said diffuse reflection layer covers said inner wall of said inner portion or covers said external surface of said power coupler.

5. The lamp as claimed in claim 4, wherein, a thickness of said diffuse reflection layer is measured from 0.01 to 5 mm.

6. The lamp as claimed in claim 1, wherein, a ratio of a maximal diameter of said external portion to a diameter of said coupling cavity is between 10:2 and 10:5.

7. The lamp as claimed in claim 6, wherein, said external portion of said glass bulb adopts a straight tube, a gourd-shaped, or a straight section in the middle, arc-shape at two ends thereof; a cross-section of said coupling cavity adopts a circle, a triangle, or a polygon.

8. The lamp as claimed in claim 1, wherein, said radiating post of said power coupler flatly contacts said ferrite core.

9. The lamp as claimed in claim 8, wherein, said radiating post of said power coupler adopts a flat structure; an upper ferrite core and a lower ferrite core of said ferrite core are respectively fixed to a front side and a back side of said flat radiating post; each ferrite core has at least one plane for contacting a surface of said radiating post.

10. The lamp as claimed in claim 1 or 8, wherein, said ferrite core adopts a structure in a continuous single section, in a two-sectional connection, or in a multi-sectional connection; said winding is disposed in said coupling cavity with an integral and even distribution or with a grouped and even distribution.

* * * * *